US007938274B2

(12) United States Patent
Yui

(10) Patent No.: US 7,938,274 B2
(45) Date of Patent: May 10, 2011

(54) PAPER SHEET PROCESSING APPARATUS

(75) Inventor: Akihiro Yui, Yokosuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 91 days.

(21) Appl. No.: 12/398,543

(22) Filed: Mar. 5, 2009

(65) Prior Publication Data

US 2009/0166948 A1 Jul. 2, 2009

Related U.S. Application Data

(62) Division of application No. 11/377,387, filed on Mar. 17, 2006, now abandoned.

(30) Foreign Application Priority Data

Jun. 20, 2005 (JP) ..... 2005-179381

(51) Int. Cl.
*B07C 5/00* (2006.01)
*B65H 29/00* (2006.01)

(52) U.S. Cl. ..... 209/534; 271/187; 271/213; 271/220; 271/223

(58) Field of Classification Search ..... 209/534; 271/187, 213, 220, 223; 194/206
See application file for complete search history.

(56) References Cited

U.S. PATENT DOCUMENTS

| | | | | |
|---|---|---|---|---|
| 4,465,192 | A * | 8/1984 | Ohba et al. | 209/534 |
| 4,539,789 | A * | 9/1985 | Miyano et al. | 53/131.2 |
| 4,702,469 | A * | 10/1987 | Jeschke et al. | 271/227 |
| 4,820,909 | A * | 4/1989 | Kawauchi et al. | 235/379 |
| 5,000,322 | A * | 3/1991 | Goi | 209/534 |
| 5,019,249 | A | 5/1991 | Sugai et al. | |
| 5,359,930 | A | 11/1994 | Hansen | |
| 5,499,805 | A * | 3/1996 | Anma | 271/3.05 |
| 5,996,314 | A * | 12/1999 | Pennini et al. | 53/399 |
| 6,220,592 | B1 * | 4/2001 | Watanabe et al. | 271/241 |
| 6,968,997 | B2 * | 11/2005 | Nomiyama et al. | 235/381 |
| 2002/0014736 | A1 | 2/2002 | Katou et al. | |
| 2004/0017039 | A1 * | 1/2004 | Asada et al. | 271/121 |
| 2006/0180516 | A1 | 8/2006 | Yui | |

FOREIGN PATENT DOCUMENTS

| | | |
|---|---|---|
| CN | 1258896 | 7/2000 |

* cited by examiner

*Primary Examiner* — Terrell H Matthews
(74) *Attorney, Agent, or Firm* — Pillsbury Winthrop Shaw Pittman, LLP

(57) ABSTRACT

A paper sheet processing apparatus has a take-in device which takes in notes set in a setting unit, a judgment device which judges the quality and condition of a note taken in by the take-in device, a stacking box which stacks the note judged the quality and condition by the judgment device, a backup which is provided movably up and down in the stacking box and stacks notes, and a control device which variably controls the position of the backup based on the result of judgment by the judgment device.

7 Claims, 17 Drawing Sheets

| Card No. | Card condition | Conversion value to the standard thickness of t of a normal card | | |
|---|---|---|---|---|
| | | Card condition level : Bad | Card condition level : Worse | Card condition level : Worst |
| n | Normal card (standard value) | 1*t | 1*t | 1*t |
| n+1 | Adhesion of tape | 1.5*t | 2*t | 3*t |
| n+2 | Bent corner | 2*t | 3*t | 4*t |
| n+3 | Peeled-off edge | 2*t | 3*t | 4*t |
| n+4 | Bent corner (raised) | 2*t | 4*t | 6*t |
| n+5 | Wrinkled | 1.5*t | 3*t | 4.5*t |
| n+6 | tired (weak) | 1.2*t | 1.4*t | 1.6*t |
| n+7 | V-shaped bent | 3*t | 5*t | 7*t |
| n+8 | Cross-shaped bent | 2*t | 4*t | 6*t |
| n+9 | Bent into 8 portions | 4*t | 4*t | 4*t |
| n+10 | Bent at both corners | 2*t | 3*t | 4*t |
| | Total | 21.2*t | 32.4*t | 44.1*t |

FIG. 13

Stacking box width = Card size + 0 ~ 1mm

Stacking box width = Card size + 3 ~ 5mm

| Card No. | Card condition | Aligning method |
|---|---|---|
| n+1 | Adhesion of tape | At a standard speed and amplitude |
| n+2 | Bent corner | At a low speed and standard amplitude in the air before stacking |
| n+3 | Peeled-off edge | At a low speed and large amplitude in the air before stacking |
| n+4 | Bent corner (raised) | At a low speed and standard amplitude in the air before stacking |
| n+5 | Wrinkled | Softly at a low speed and small amplitude immediately before stacking |
| n+6 | Tired (weak) | Softly at a low speed and small amplitude immediately before stacking |
| n+7 | V-shaped bent | At a low speed and standard amplitude |
| n+8 | Cross-shaped bent | At a low speed and standard amplitude |
| n+9 | Bent into 8 portions | At a low speed and standard amplitude |
| n+10 | Bent at both corners | In the air after feeding out from the impeller and before stacking |
| n+11 | Normal card | At a standard speed and amplitude if the quality and condition are good |
| n+12 | Official sealed card | At a standard speed and amplitude (A cad pops out if tapped strongly) |

FIG. 18

PAPER SHEET PROCESSING APPARATUS

CROSS-REFERENCE TO RELATED APPLICATIONS

This application is a divisional of co-pending U.S. application Ser. No. 11/377,387, filed Mar. 17, 2006, and for which priority is claimed under 35 U.S.C. §121. This application is based upon and claims the benefit of priority under 35 U.S.C. §119 from the prior Japanese Patent Application No. 2005-179381, filed Jun. 20, 2005, the entire contents of both applications are incorporated herein by reference in their entireties.

BACKGROUND OF THE INVENTION

1. Field of the Invention

The present invention relates to a paper sheet processing apparatus, which is applied as a paper money processing apparatus, for example, for classifying and stacking paper money in stacking boxes according to the kinds of money and whether the condition of money is normal or damaged.

2. Description of the Related Art

A paper money processing apparatus of this kind is functionally divided into a sorting machine, a money counting machine and a normal/damaged classifying machine. The sorting machine has a setting unit to set paper money (hereinafter called a note), a take-in device to take in and feed the paper money set in the setting unit, and a judgment unit to judge the kind, front/back, direction and true/false of a note. The machine classifies and stacks a specified number of notes in a stacking box based on the result of the judgment.

A note failed to judge by the judgment unit, or judged impossible to handle in the machine is classified into a rejection box.

The money counting machine has a data add-up function added to the money sorting machine, and counts the input money data for each transaction batch, adds up the transaction amount of a day, and totalizes the input money for each customer. When receipt of money for each transaction is confirmed, a large number of notes are often continuously stacked in a stacking box in many cases. The stacking number of notes is set to 100-2000 for one stacking box, for examples.

The normal/damaged classifying machine judges whether a note taken in from a take-in device is normal or damaged in a judgment unit, and classifies the note into normal or damaged based on the result of judgment, and stacks the note. A note is judged damaged, if a degree of stain or damage exceeds a preset level. A damaged note is bad in the quality and condition, having adherence of tape, bent corner, peeled-off end, tear, wrinkle, and tired, for example. The damaged note classifying performance of the normal/damaged classifying machine depends much upon the quality and condition of a note.

The stacking box is provided with a backup, a width guide and a position adjusting guide. The width of a note led into the stacking box is guided by the width guide, stacked on a backup, and adjusted the longish side by the position adjusting guide. An impeller is provided in the note input side of the stacking box, to guide notes one by one to the stacking box.

However, in the prior art, the backup descends a certain distance whenever a predetermined number of notes are stacked on the backup, and the height of stacked notes is varied depending on the quality and conditions of a note.

When the height of stacked notes increases, a space to receive a subsequent note is not ensured, causing a jam or a stack error. Contrarily, when the height of stacked notes decreases, the distance to drop a note becomes long, the position of a note becomes unstable, and a note is stacked in being stood or inclined.

Particularly, when the apparatus is used as a money counting machine, the stack height is uneven and the stacking performance becomes unstable when the backup descent distance is controlled to a certain level, because a number of notes are stacked and the quality and condition of each note are different in each batch of receipts from a different customer.

In the prior art, the position of the width guide in a stacking box is uniformly controlled according to the sizes of note, and if the position of the width guide is set to a note size+0~1 mm, for example, and the quality and condition of a note are bad, the corner and edge of a note is caught by the width guide, causing a stack error.

In the prior art, the position adjusting operation of the position adjusting guide is controlled according to the size of each kind of note (speed, amplitude, number of position adjustment, and position adjusting timing for each note), and the edge of note is not aligned as expected and the stacking performance may become bad. For example, a tired note is merely bent and the stacking position is not adjusted as expected, even if the position is adjusted at a high speed and large amplitude. A note having a bent corner or peeled-off end is not normally positioned even if the note position is adjusted in the stacked state, because the bent corner or peeled-off end is caught by the upper and lower notes.

In the prior art, an impeller is provided in a fixed condition, and when a note fed to a stacking box is displaced to the sliding direction against to the center of the feeding, the position and center of gravity of a note against the impeller are displaced, the balance becomes bad, and the note drops or projects from the impeller, giving a bad influence to the stacking performance. A note asymmetrical to the center, for example, a note having a peeled-off edge or a largely bent corner, or a broken note is displaced from the impeller or the center of gravity is displaced, and the balance becomes bad and drops or projects from the impeller, giving a bad influence to the stacking performance.

BRIEF SUMMARY OF THE INVENTION

The present invention has been made under the above circumstances. Accordingly, it is an object of the invention to provide a paper sheet processing apparatus which is configured to stack paper sheets in a good condition by variably controlling the positions of backup and width guide of a stacking device, and the position adjusting operation of a position adjusting guide, and the position of a impeller, according to the quality and condition of a paper sheet.

According to an aspect of the invention, there is provided a paper sheet processing apparatus comprising a setting unit which sets paper sheets, a take-in device which takes in the paper sheets set in the setting unit, a judgment device which judges the quality and condition of a paper sheet taken in by the take-in device, a stacking device which stacks the paper sheet judged the quality and condition by the judgment device, a backup which is provided movably up and down in the stacking device and stacks paper sheets, and a control device which variably controls the position of the backup based on the judgment result of the judgment device.

According to an aspect of the invention, there is provided a paper sheet processing apparatus comprising a setting unit which sets paper sheets, a take-in device which takes in the paper sheets set in the setting unit, a judgment device which judges the quality and condition of a paper sheet taken in by the take-in device, a stacking device which stacks the paper sheet judged the quality and condition by the judgment device, a width guide which guides the width direction of a paper sheet stack in the stacking device, and a control device which controls the position of the width guide based on the result of judgment by the judgment device.

According to another aspect of the invention, there is provided a paper sheet processing apparatus comprising a setting unit which sets paper sheets, a take-in device which takes in the paper sheets set in the setting unit, a judgment device which judges the quality and condition of a paper sheet taken in by the take-in device, a stacking device which stacks the paper sheet judged the quality and condition by the judgment device, a position adjusting mechanism which adjusts a paper sheet stacked in the stacking device by reciprocating a pair of position adjusting guides in the direction of separating from each other, and a control device which controls the position adjusting operation of the pair of position adjusting guides of the position adjusting mechanism based on the result of judgment by the judgment device.

According to another aspect of the invention, there is provided a paper sheet processing apparatus comprising a setting unit which sets paper sheets, a take-in device which takes in the paper sheets set in the setting unit, a judgment device which judges the quality and condition of a paper sheet taken in by the take-in device, a stacking device which stacks the paper sheet judged the quality and condition by the judgment device, an impeller unit which involves a paper sheet fed toward the stacking device in blades and guides the paper sheet to the stacking device, and a control device which controls the impeller unit to move in the direction orthogonal to the paper sheet leading direction based on the result of judgment by the judgment device.

According to the present invention, the position of the backup as a stacking means, the position of the width guide, the position adjusting operation of the position adjusting guide, and the position of the impeller can be variably controlled according to the quality and condition of a paper sheet, and a paper sheet can be stacked in a good condition regardless of the quality and condition of a paper sheet.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIG. 13 is a table showing the conditions of notes stacked in the stacking box of FIG. 2 and the conversion values to a standard thickness of a normal note;

FIG. 18 is a table showing the conditions of notes in the aligning mechanism of FIG. 4 and an aligning method;

DETAILED DESCRIPTION OF THE INVENTION

Hereinafter, embodiments of the present invention will be explained in details with reference to the accompanying drawings.

Figure 1:
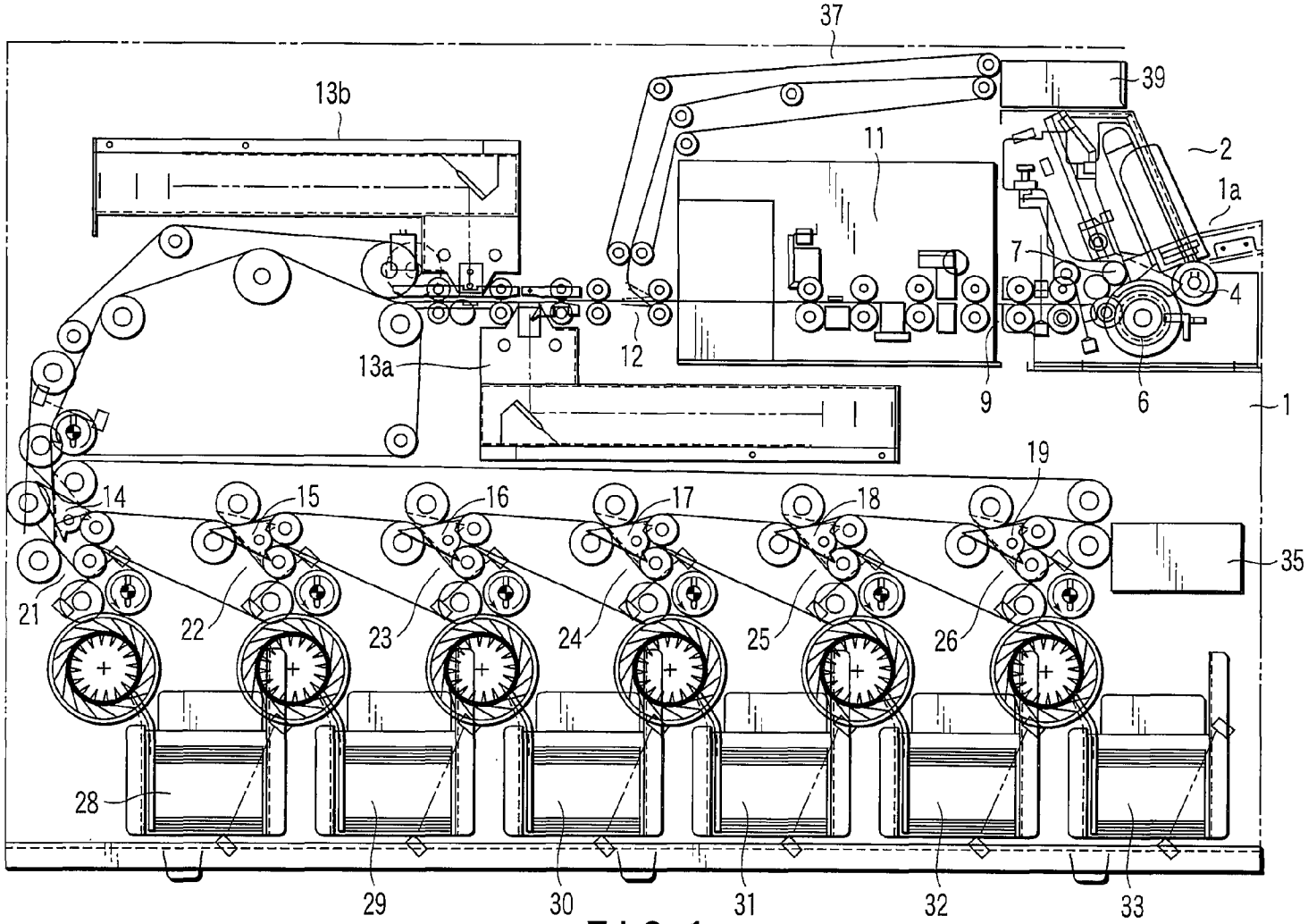
FIG. 1 is a drawing showing the configuration of a whole paper sheet processing apparatus according to an embodiment of the present invention.

FIG. 1 is a schematic illustration showing a paper money processing machine as a paper sheet processing apparatus according to an embodiment of the present invention.

In FIG. 1, a reference numeral 1 denotes a main body of the apparatus. The main body 1 includes a setting unit 1*a* in one side, in which paper money P (hereinafter called a note) as a paper sheet is set in a stacked state. A note P set in the setting unit 1*a* is taken in by a take-in device 2 as a takeoff device.

A take-in roller 4 is provided in the take-in device 2. In the note take-in direction of the take-in roller 4, a feeding roller 6 is provided, and a separating roller 7 is provided in the state rotating and contacting the upper side of the feeding roller 6.

The note P fed by the feeding roller 6 is fed along a feeding path 9 as a feeding device. In the feeding path 9, there are provided a first detector (optical detector, thickness detector, magnetism detector) 11, a sorting gate 12, a second detector (CCD optical detector) 13*a*/13*b*, and a first to sixth sorting gates 14-19.

The first detector (optical detector, thickness detector, magnetism detector) 11 optically and magnetically detects the shape and contents of a note, and detects the thickness. The second detector 13*a*/13*b* has a CCD optical system with high resolution and deep depth of field, and exactly detects a note.

The first to sixth sorting gates 14-19 guide a note selectively to first to sixth branches 21-26. In the note rejection side of the first to sixth branches 21-26, first to sixth stacking boxes 28-33 are provided as a stacking device.

In the feed-out side of the feeding path 9, a stacking box 35 for a false note is provided to stack a false note. A rejection box 39 is provided in the above sorting gate 12 through a rejection path 37. The rejection box 39 stacks a skewed or doubly fed and rejected note.

Figure 2:
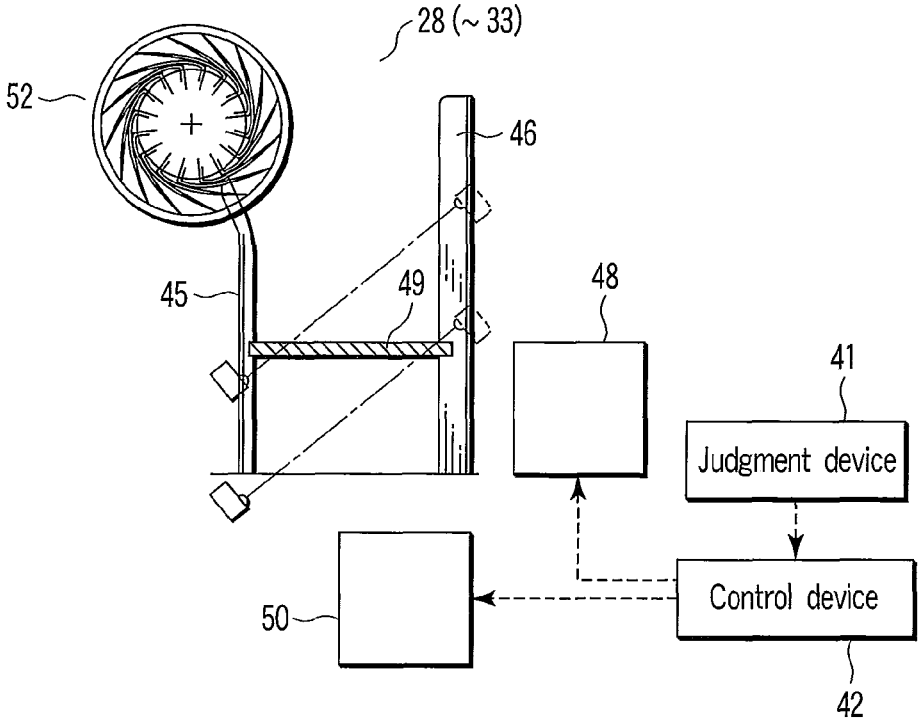
FIG. 2 an illustration showing a stacking box of the paper sheet processing apparatus of FIG. 1.

FIG. 2 is a diagram showing a configuration of a stacking box 28 (28-33).

The stacking box 28 (28-33) has first and second guide plates 45 and 46. The first and second guide plates 45 and 46 guide the shorter side of a note to be stacked in the stacking box 28. The first guide plate 45 is provided in a fixed state. The second guide plate 46 (hereinafter called a width guide) is provided movably in the direction of closing to and separating from the guide plate 45.

A first driving motor 48 is connected to the width guide 46 through a power transmission mechanism (not shown). The first driving motor 48 moves the width guide 46 in the direction of closing to and separating from the first guide plate 45.

Figure 3:
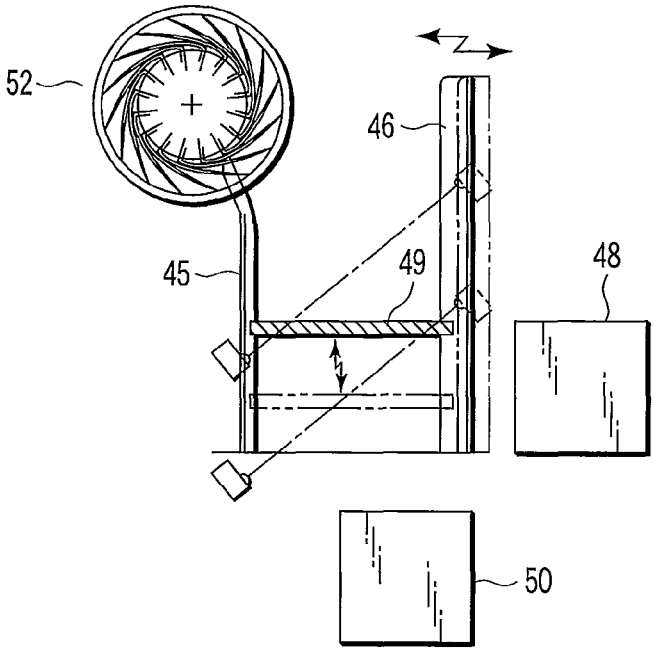
FIG. 3 is an illustration showing the moving direction of a backup plate and width guide of the stacking box of FIG. 2.

A backup plate (backup) 49 to stack a note is provided movably in the ascending and descending directions, between the first guide plate 45 and width guide 46. The backup plate 49 is connected with a second driving motor 50 through a not-shown power transmission mechanism. The second driving motor 50 moves up and down the backup plate 49 as indicated by an arrow in FIG. 3.

In the upper side of the first guide plate 45, there is provided an impeller unit 52, which rotates and involves a fed note in an impeller, and guides the note to the stacking box 28 (28-33).

Figure 4:
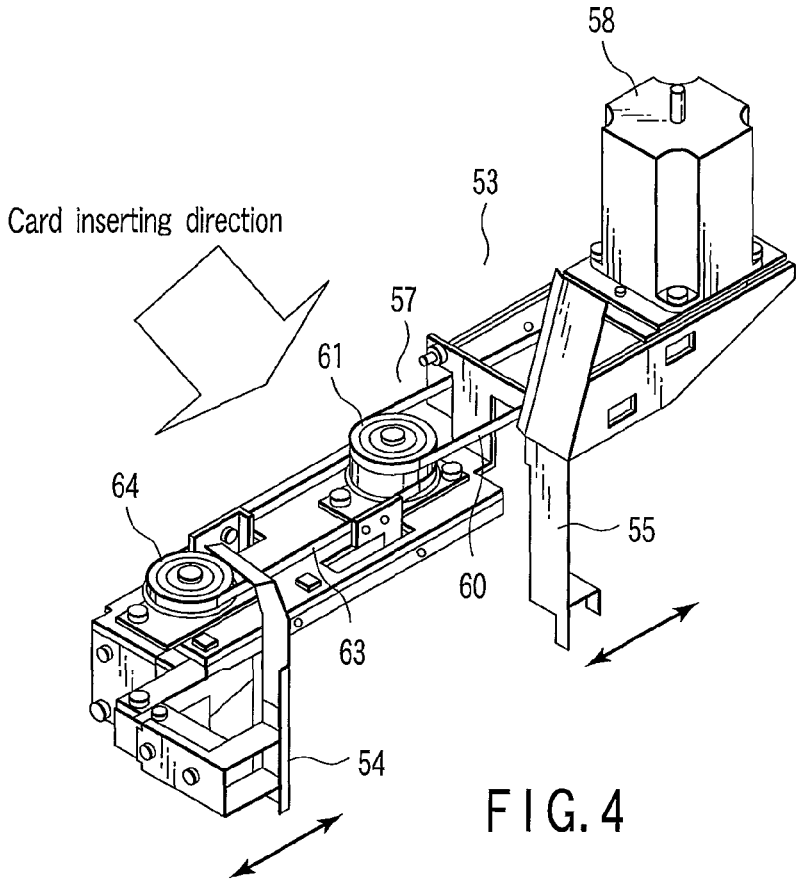
FIG. 4 is a perspective view of an aligning mechanism of the stacking box of FIG. 2.
Figure 5:
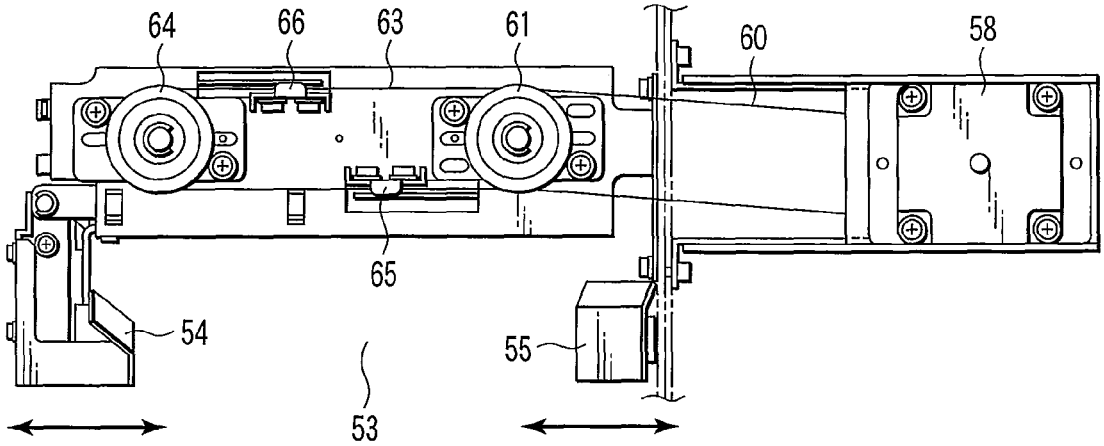
FIG. 5 is a plane view of the aligning mechanism of FIG. 4.
Figure 6:
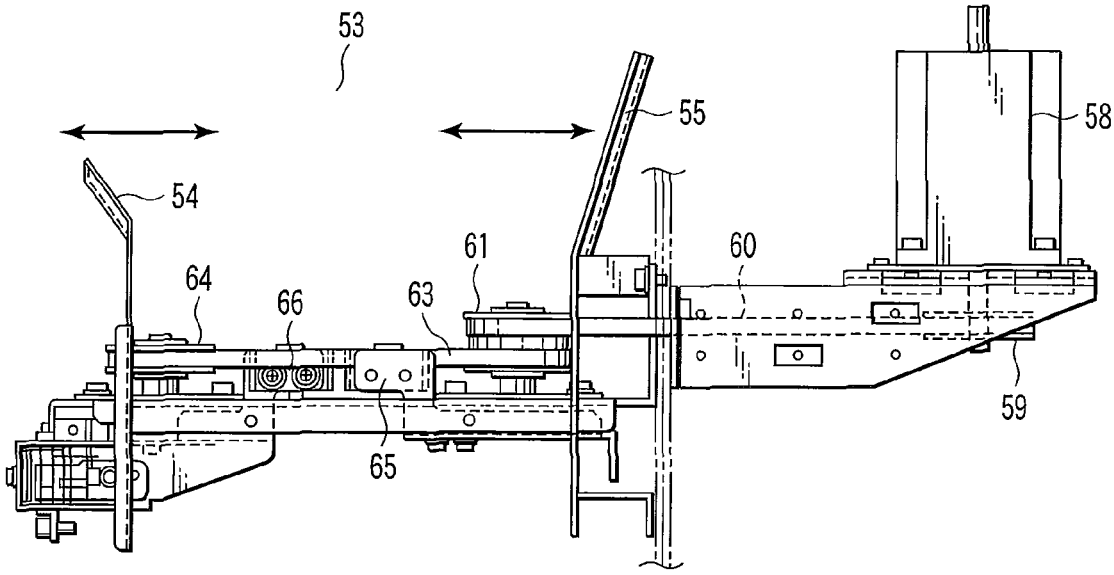
FIG. 6 is a side view of the aligning mechanism of FIG. 4.

FIG. 4 is a perspective view showing an aligning mechanism 53, which adjusts the longish side direction of a note to be stacked in the stacking box 28 (28-33). FIG. 5 is a plane view of the aligning mechanism. FIG. 6 is a side view of the aligning mechanism.

The aligning mechanism 53 has first and second aligning guides 54 and 55. The first and second aligning guides 54 and 55 are connected to a third driving motor 58 through a power transmission mechanism 57. The power transmission mechanism 57 has a first follower pulley 61 connected to a driving pulley 59 of the third driving motor 58 through a first timing belt 60, and a second follower pulley 64 connected to the first follower pulley 61 through a second timing belt 63. The first and second aligning guides 54 and 55 are fixed to the second timing belt 63 through fixing tools 65 and 66, and moved by the second timing belt 63 in the direction of closing to and separating from each other just like reciprocating.

Figure 7:
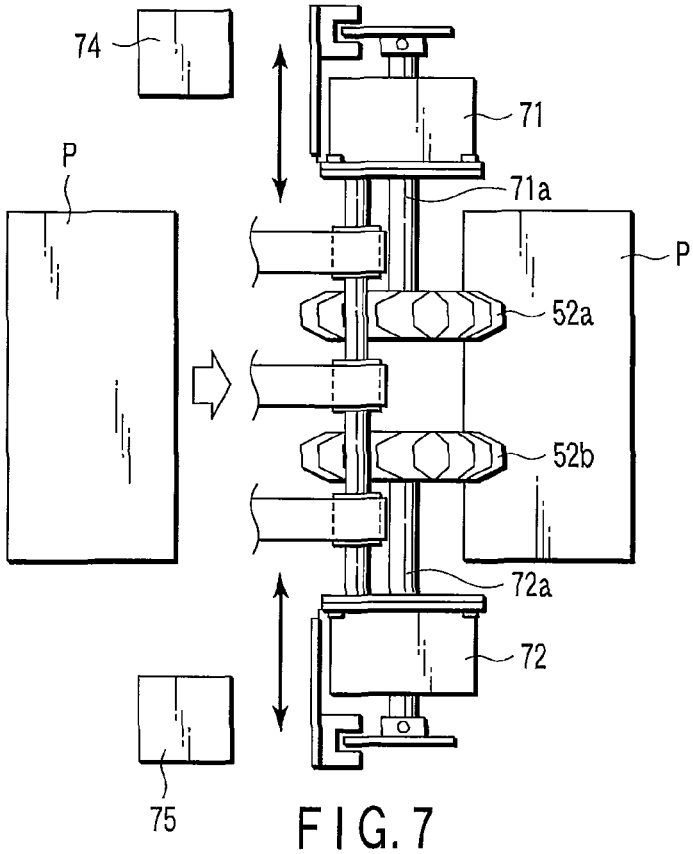
FIG. 7 is a plane view of an impeller of the stacking box of FIG. 2.

FIG. 7 is a plane view of a driving mechanism of the impeller unit 52.

The impeller unit 52 has first and second impellers 52*a* and 52*b* provided opposite to each other through a fixed interval in the direction rectangular to the note lead-in direction. The first impeller 52*a* is connected to a driving shaft 71*a* of a first rotating motor 71, and the second impeller 52*b* is connected to a driving shaft 72*a* of a second rotating motor 72. The impellers are rotated by the connected driving shafts.

Fourth and fifth driving motors 74 and 75 are provided in proximity to the first and second impellers 52*a* and 52*b*. The fourth and fifth driving motors 74 and 75 are connected with the first and second impellers 52*a* and 52*b* through a not-shown power transmission mechanism. The first and second impellers are moved by the fourth and fifth driving motors 74 and 75 in the direction of closing to and separating from each other, in the same direction along the longish side of a note, or independently along the longish side of a note.

Figure 8:
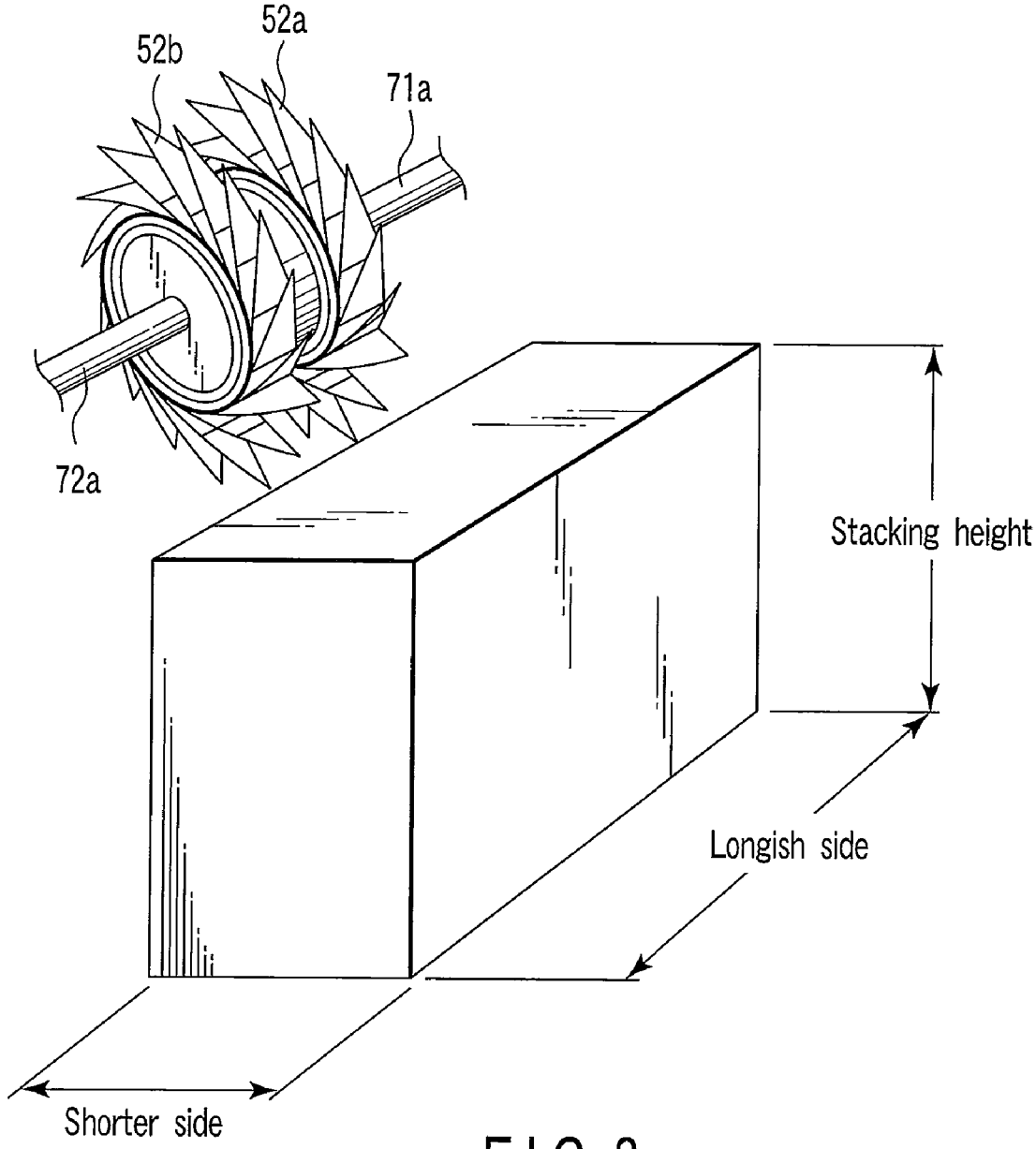
FIG. 8 is a view showing the shorter side, longish side and stacking height of a note to be stacked in the stacking box of FIG. 2.

FIG. 8 is a perspective view showing the shorter side, longish side and stack height of a note to be stacked in the stacking box 28.

Figure 9:
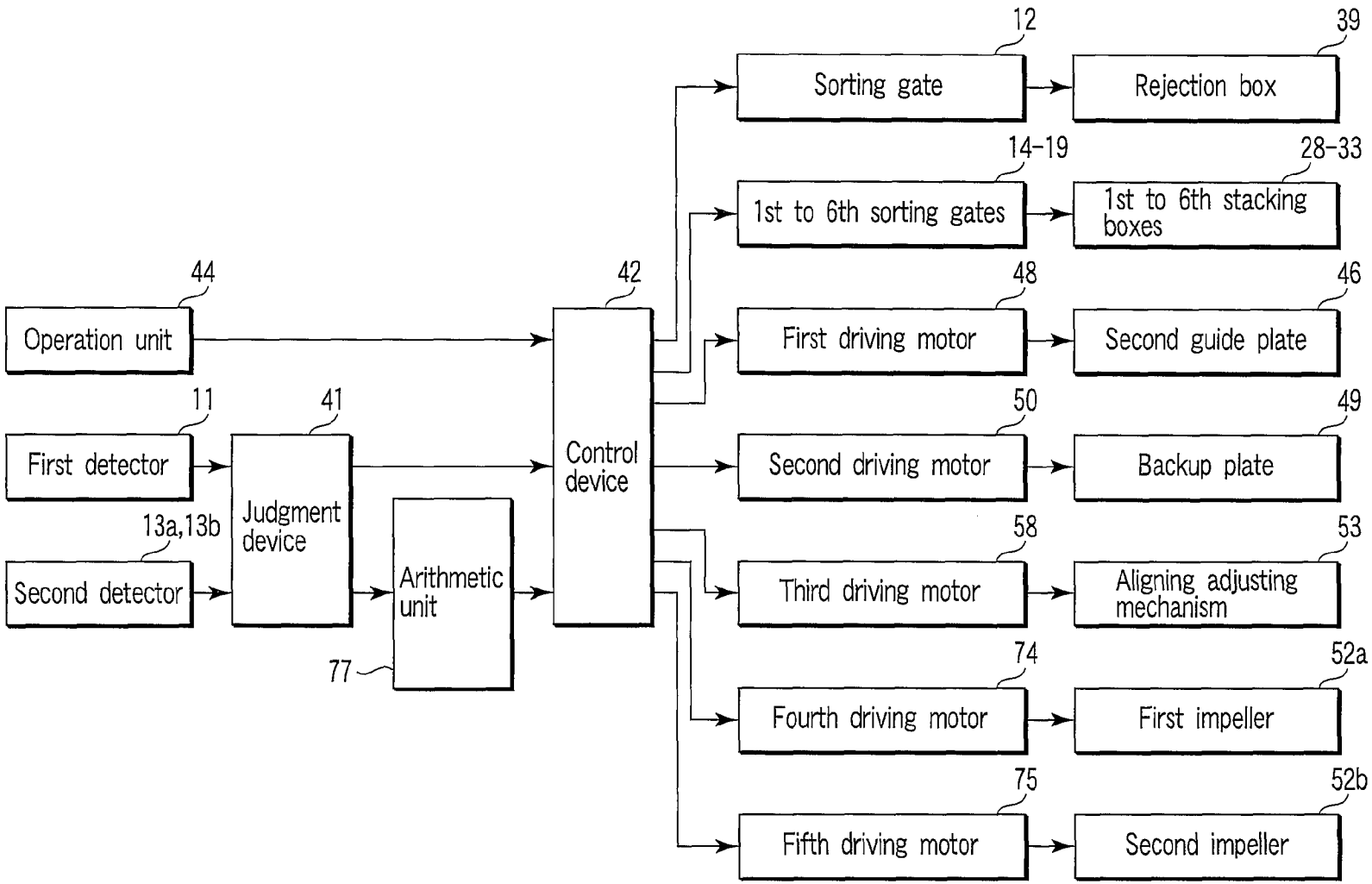
FIG. 9 is a block diagram of a drive control system of the stacking box of FIG. 2.

FIG. 9 is a block diagram of a drive control system of the sorting gate 12, first to sixth sorting gates 14-19, and first to fifth driving motors 48, 50, 58, 74 and 75.

The first and second detectors 11, 13*a* and 13*b* are connected to a judgment device 41 as a judgment device through a transmission circuit to transmit a detection signal. The judgment device 41 is connected with a control device 42 as a control device through a transmission circuit and an arithmetic unit 77. The control device 42 is connected with an operation unit 44 through a transmission circuit.

The control device 42 is connected with the sorting gate 12, first to sixth sorting gates 14-19 and first to fifth driving motors 48, 50, 58, 74 and 75, through a control circuit.

The judgment device 41 judges whether a note is true or false and normal or damaged based on the information detected by the detector 11, and judges the thickness, quality and condition of a note based on the information detected by the second detectors 13*a* and 13*b*.

Figure 10:
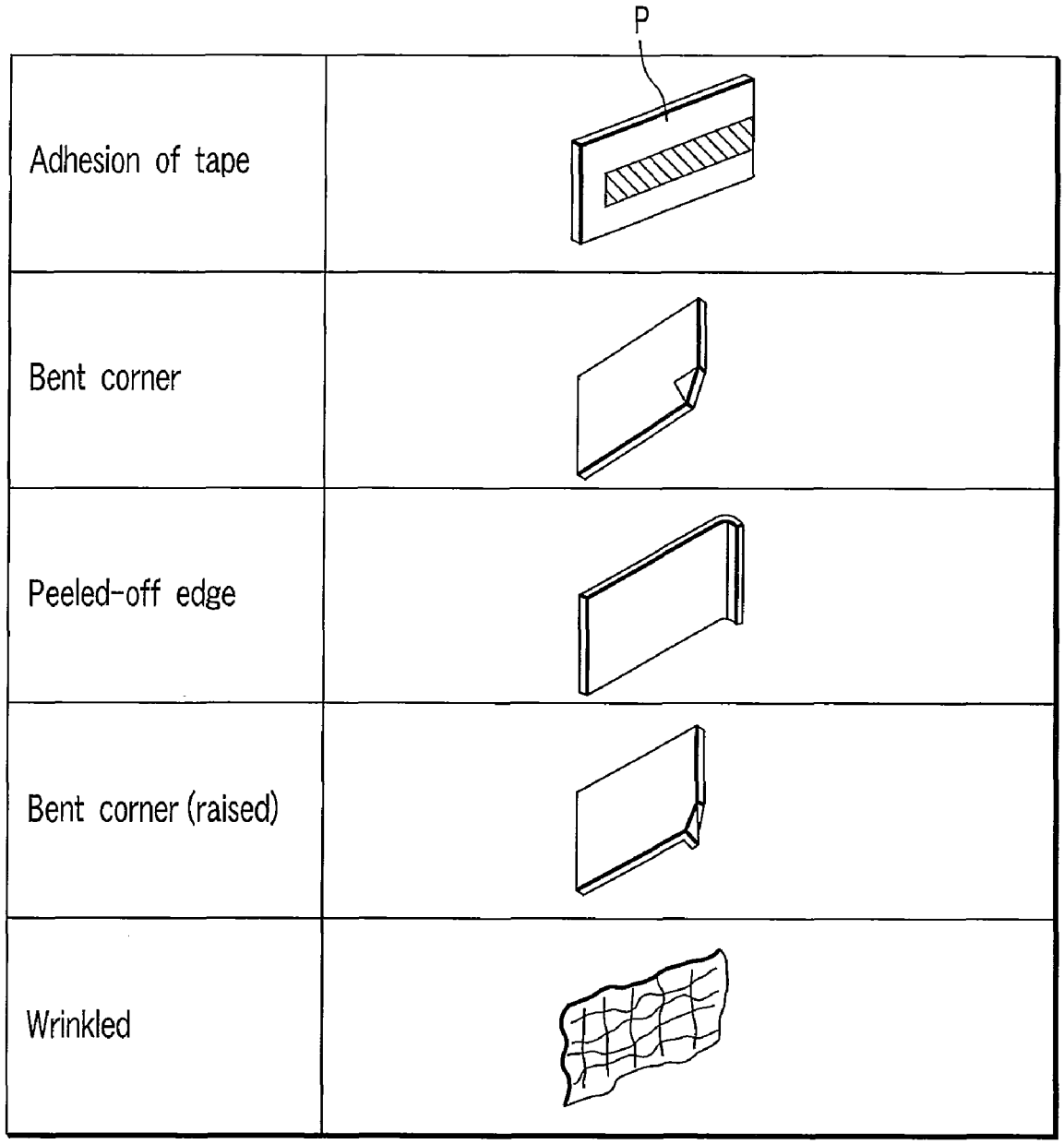
FIG. 10 is a table showing the quality and conditions of notes stacked in the stacking box of FIG. 2.
Figure 11:
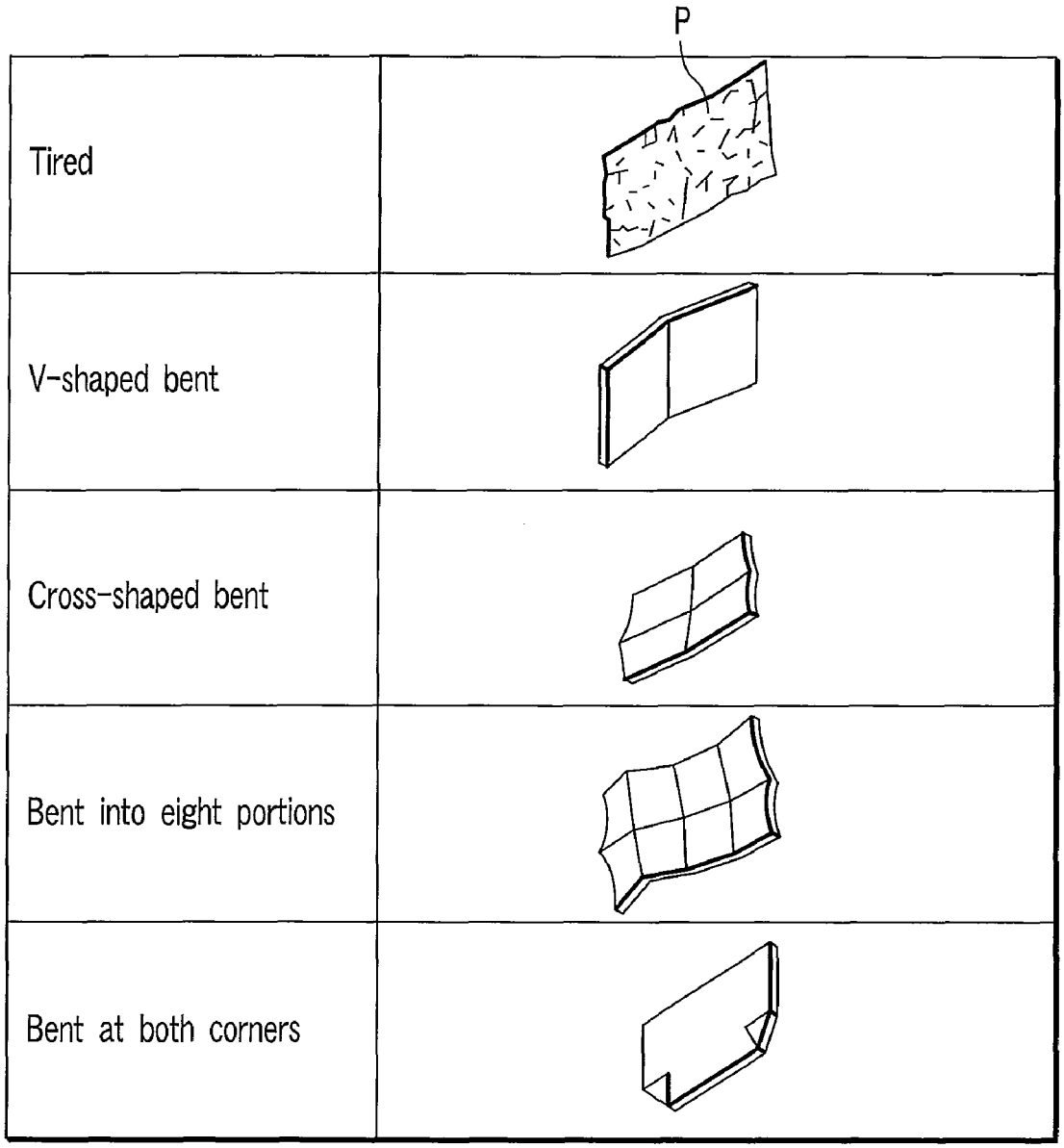
FIG. 11 is a table showing the quality and conditions of notes stacked in the stacking box of FIG. 2.

FIG. 10 and FIG. 11 show the quality and conditions of a note.

Namely, the quality and conditions of a note include adhesion of tape, broken corner, peeled-off edge, bent corner (raised), wrinkled, tired, V-shaped bent, cross-shaped bent, bent into eight portions, and bent at both corners.

Figure 12:
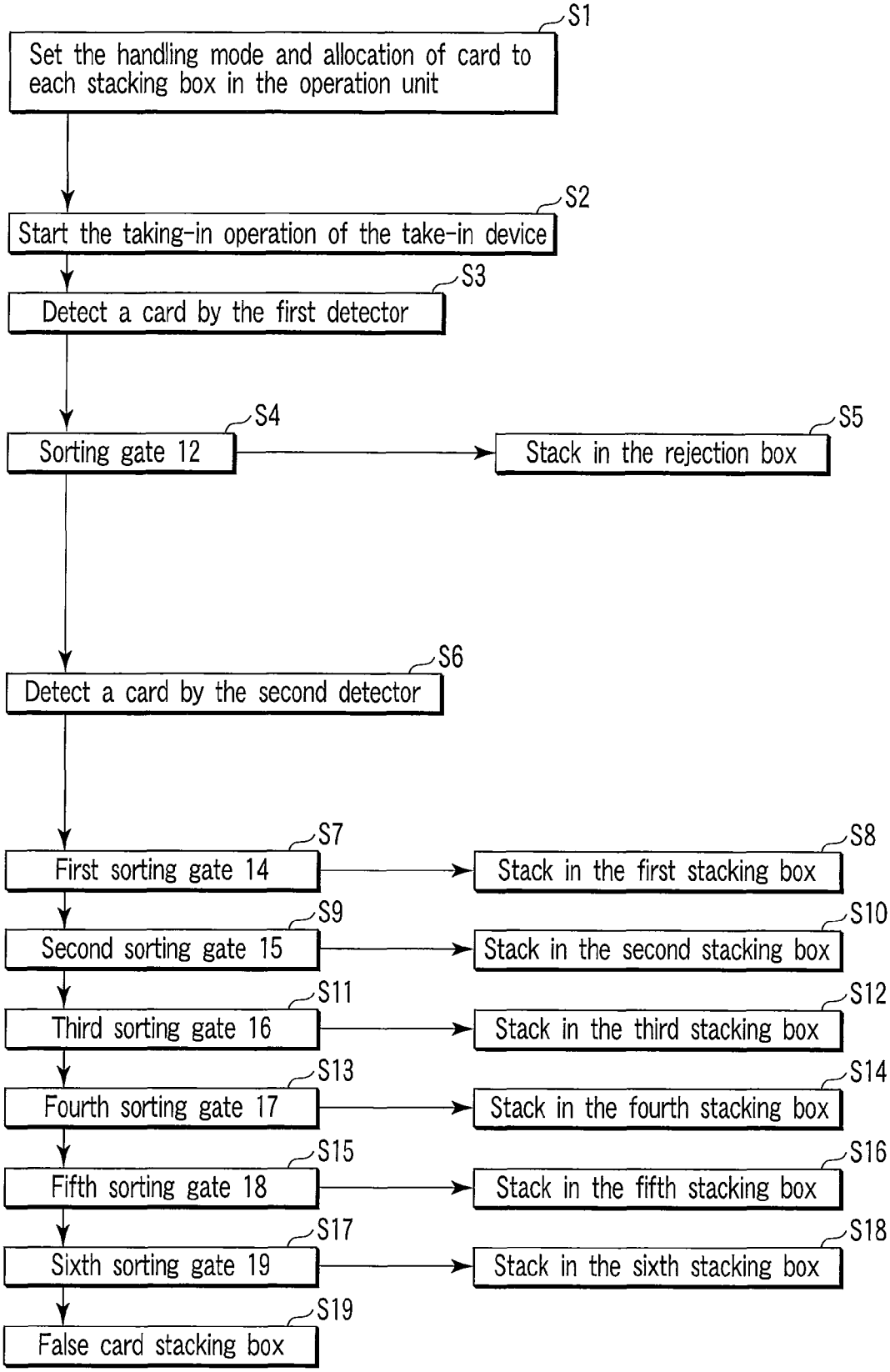
FIG. 12 is a flow chart showing the note classifying and stacking operations of the paper sheet processing apparatus of FIG. 1.
Figure 14A:
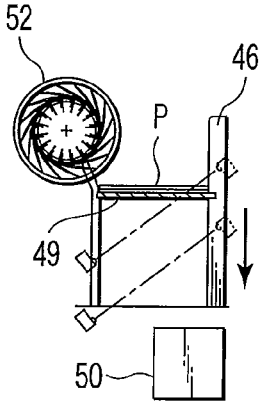
FIG. 14A is an illustration showing a state of stacking notes of uneven quality and condition in the stacking box of FIG. 2.
Figure 14B:
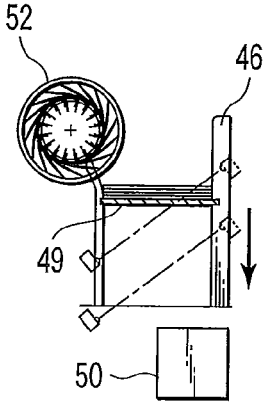
FIG. 14B is an illustration showing a state of stacking notes of uneven quality and condition in the stacking box of FIG. 2.
Figure 14C:
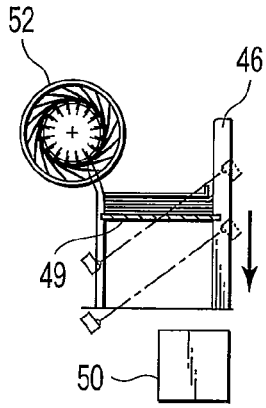
FIG. 14C is an illustration showing a state of stacking notes of uneven quality and condition in the stacking box of FIG. 2.
Figure 14D:
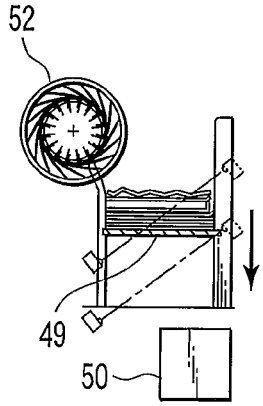
FIG. 14D is an illustration showing a state of stacking notes of uneven quality and condition in the stacking box of FIG. 2.
Figure 14E:
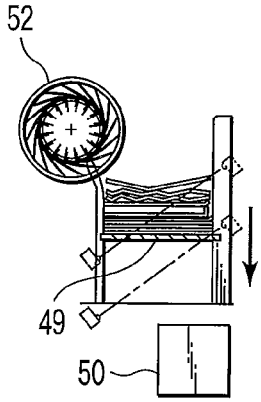
FIG. 14E is an illustration showing a state of stacking notes of uneven quality and condition in the stacking box of FIG. 2.
Figure 14F:
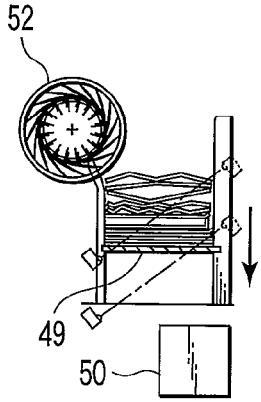
FIG. 14F is an illustration showing a state of stacking notes of uneven quality and condition in the stacking box of FIG. 2.
Figure 14G:
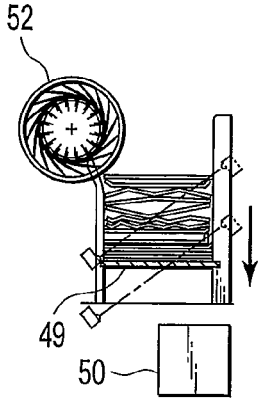
FIG. 14G is an illustration showing a state of stacking notes of uneven quality and condition in the stacking box of FIG. 2.
Figure 14H:
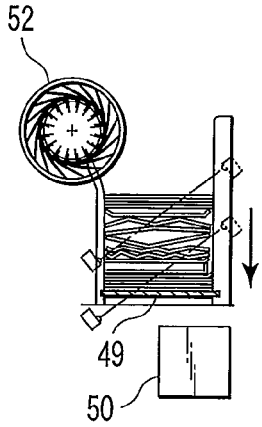
FIG. 14H is an illustration showing a state of stacking notes of uneven quality and condition in the stacking box of FIG. 2.
Figure 14I:
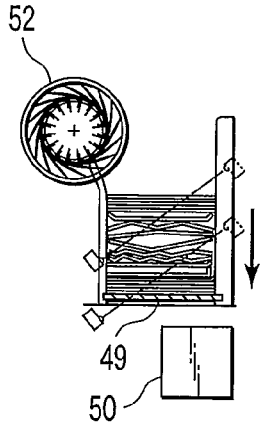
FIG. 14I is an illustration showing a state of stacking notes of uneven quality and condition in the stacking box of FIG. 2.
Figure 14J:
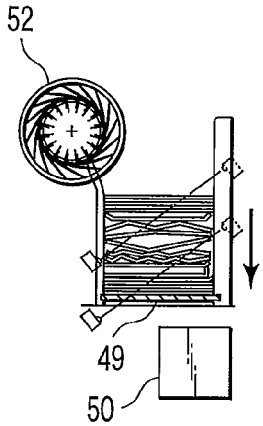
FIG. 14J is an illustration showing a state of stacking notes of uneven quality and condition in the stacking box of FIG. 2.
Figure 15A:
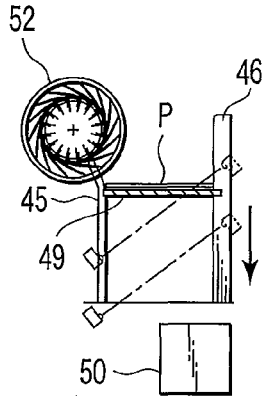
FIG. 15A is an illustration showing a state of stacking notes of even quality and condition in the stacking box of FIG. 2.
Figure 15B:
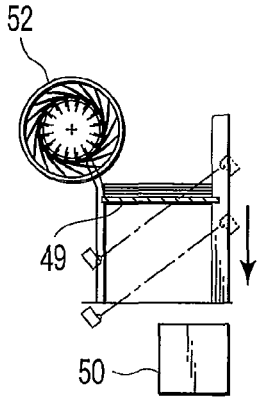
FIG. 15B is an illustration showing a state of stacking notes of even quality and condition in the stacking box of FIG. 2.
Figure 15C:
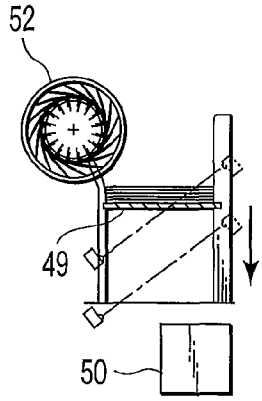
FIG. 15C is an illustration showing a state of stacking notes of even quality and condition in the stacking box of FIG. 2.
Figure 15D:
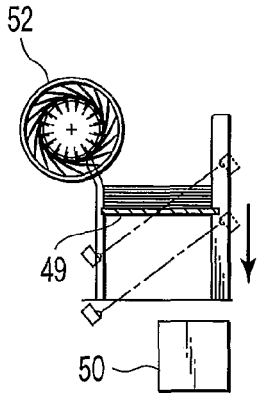
FIG. 15D is an illustration showing a state of stacking notes of even quality and condition in the stacking box of FIG. 2.
Figure 15E:
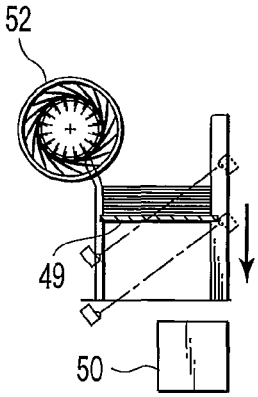
FIG. 15E is an illustration showing a state of stacking notes of even quality and condition in the stacking box of FIG. 2.
Figure 15F:
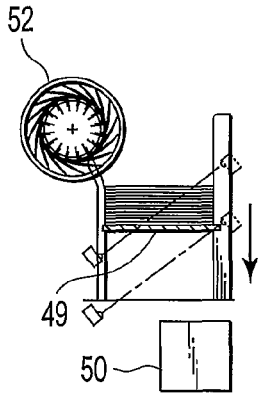
FIG. 15F is an illustration showing a state of stacking notes of even quality and condition in the stacking box of FIG. 2.
Figure 15G:
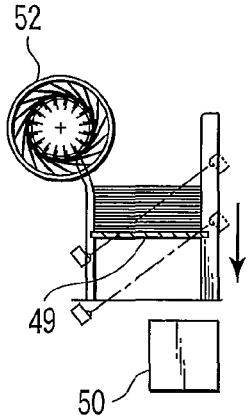
FIG. 15G is an illustration showing a state of stacking notes of even quality and condition in the stacking box of FIG. 2.
Figure 15H:
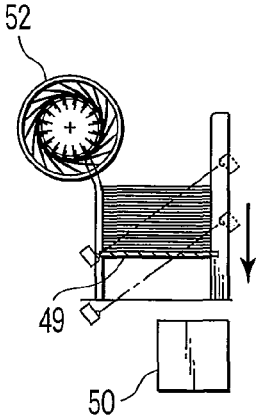
FIG. 15H is an illustration showing a state of stacking notes of even quality and condition in the stacking box of FIG. 2.
Figure 15I:
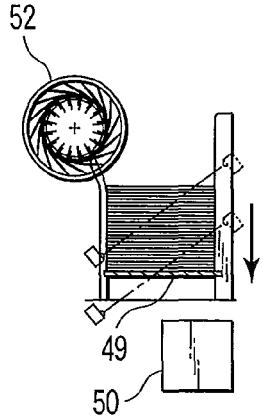
FIG. 15I is an illustration showing a state of stacking notes of even quality and condition in the stacking box of FIG. 2.
Figure 15J:
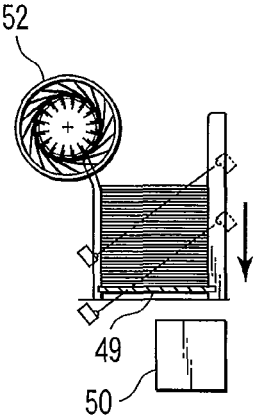
FIG. 15J is an illustration showing a state of stacking notes of even quality and condition in the stacking box of FIG. 2.

Next, explanation will be given on the processing operation of the paper money processing apparatus with reference to the flow chart of FIG. 12.

The operation unit (or PC) 44 sets a handling mode, for example, judgment of normal\damaged, and sets allocation of notes to stacking boxes 28-33 (step S1). For example, allocate the first stacking box 28 to a damaged note, and the second to sixth stacking boxes 29-33 to a normal note.

Then, the take-in roller 4 of the take-in device 2 is rotated, and a note P is taken in (step S2). The note is separated and delivered one by one by the feeding roller 6 and separating roller 7. The delivered note is fed along the feeding path 9. The first detector 11 optically and magnetically detects the shape and contents of the note, and detects the thickness (step S3).

The judgment device 41 judges whether the note is true or false and normal or damaged based on the detected information, and judges whether the note is skewed or doubly taken in. The sorting gate 12 sorts out the note judged skewed or doubly taken in, and feeds the note to the rejection path 37 (step S4). The note is returned to the rejection box through the rejection path 37 (step S5).

A note judged not skewed or doubly taken in is fed to the second detectors 13*a* and 13*b*, without sorted by the sorting gate 12, and optically detected (step S6). The thickness, quality and condition of the note are judged based on the detected information.

A note judged normal is sorted by the second to sixth sorting gates 15-19 according to the kinds of the note (steps S9-S17), and stacked in the second to six stacking boxes 29-33 (step S10-S18).

A note judged damaged is sorted by the first sorting gate 14 (step 7), and stacked in the first stacking box 28 (step S8).

When a note is judged false, the first to sixth sorting gates 14-19 are not operated. The note is rejected from the feed-out end of the feeding path 9, and stacked in the stacking box 35 for a false note (step S19).

Next, explanation will be given on the operation of the backup plate 49 when a note is stacked.

As described above, when the thickness, quality and condition of a note is judged by the judgment device 41, the arithmetic unit 77 estimates the stack height per one note based on the result of judgment, and calculates the height of the notes stacked in the stacking box based on the estimated stack height and the number of stacked notes. The control device 42 controls the driving of the second driving motor (pulse motor) 50 for moving up/down the backup based on the calculated value, and variably controls the shift amount of the backup plate 49 from a reference position.

Control of the depth of the stacking box 28 (28-33) (control of the descending amount of the backup plate 49) is available in two methods, continuous control of the depth of stack whenever one note is stacked, and stepwise control of the depth of the stacking box 20 (20-33) whenever 20 notes are stacked, for example.

FIG. 13 shows the estimated stack height per one note based on the result of judgment of each note by the judgment device 41, when the quality and condition of a note are not even.

When a note of middle level condition is stacked ten sheets, n+1 to n+10, the control device 42 controls the height of the stack backup 49 and controls the depth of the stacking box to (t×0+10) mm to (t×32.4+10) mm based on the result of judgment of each note by the judgment device 41, as shown in FIGS. 14A-14J.

FIGS. 15A-15J illustrate a case of stacking 500 notes in the stacking box 29 (29-33), which are judged new, free from bent corner, peeled-off edge, curve and curl, and good in quality and even in the thickness.

The depth of the stacking box 29 (29-33) is adjusted to meet the stacked note height, for example, (t×0+10) mm−(t×500+10) mm (the initial depth is assumed to be 10 mm).

The height of the backup plate 49 is adjusted to optimize the depth of the stacking box 28 (28-33) based on the result of judgment by the judgment device 41 as described above, and the notes can be stably stacked regardless of the quality and conditions.

Next, explanation will be given on the operation of the width guide 46 during stacking of notes.

When the thickness, quality and condition of a note are judged one by one by the judgment device 41 as described above, the control device 42 controls the operation of the first driving motor (pulse motor) 48 and variably controls and optimizes the shift amount of the width guide 46 from a reference position.

FIGS. 16A-16E illustrate a case of stacking notes by adjusting the width guide 46 of the stacking box evenly to a reference dimension of note (note size+0−1 mm) regardless of the quality and conditions of a note.

Figure 16A:
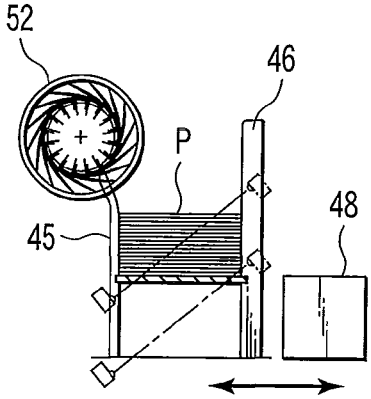
FIG. 16A is an illustration showing a state of stacking notes in the stacking box of FIG. 2, with a width guide set to a fixed position.
Figure 16B:
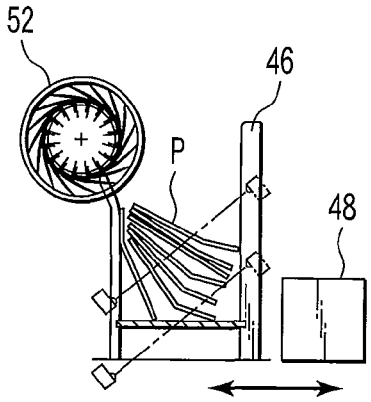
FIG. 16B is an illustration showing a state of stacking notes in the stacking box of FIG. 2, with a width guide set to a fixed position.
Figure 16C:
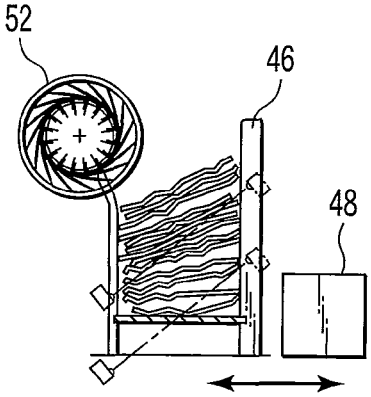
FIG. 16C is an illustration showing a state of stacking notes in the stacking box of FIG. 2, with a width guide set to a fixed position.
Figure 16D:
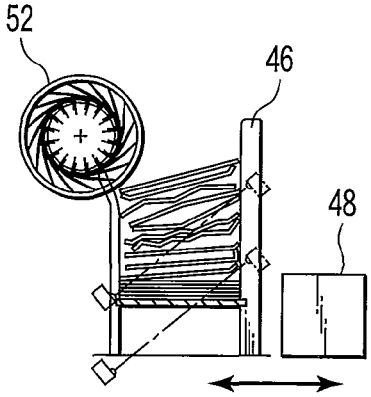
FIG. 16D is an illustration showing a state of stacking notes in the stacking box of FIG. 2, with a width guide set to a fixed position.
Figure 16E:
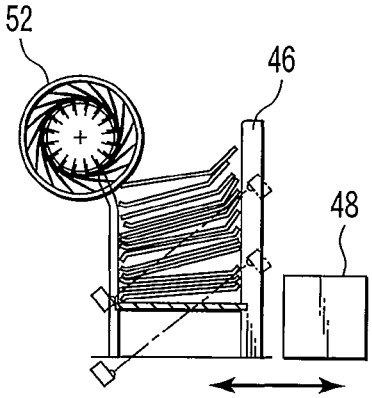
FIG. 16E is an illustration showing a state of stacking notes in the stacking box of FIG. 2, with a width guide set to a fixed position.
Figure 17A:
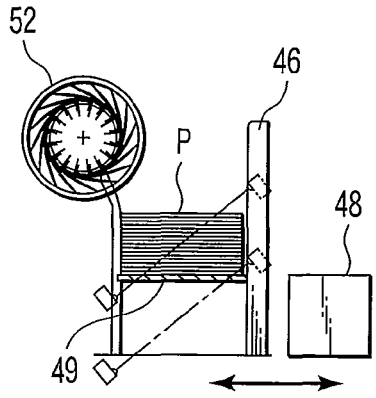
FIG. 17A is an illustration showing a state of stacking notes in the stacking box of FIG. 2, with the position of a width guide controlled variably according to the quality and condition of a note.
Figure 17B:
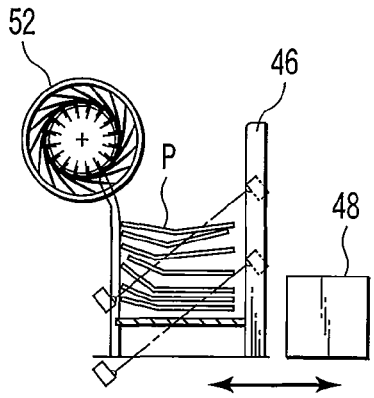
FIG. 17B is an illustration showing a state of stacking notes in the stacking box of FIG. 2, with the position of a width guide controlled variably according to the quality and condition of a note.
Figure 17C:
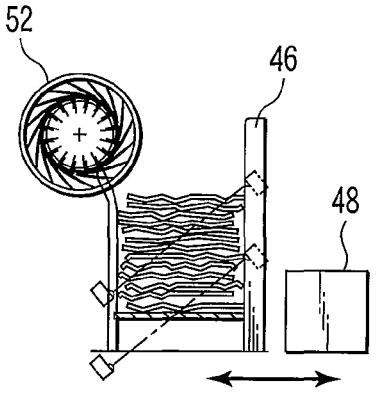
FIG. 17C is an illustration showing a state of stacking notes in the stacking box of FIG. 2, with the position of a width guide controlled variably according to the quality and condition of a note.
Figure 17D:
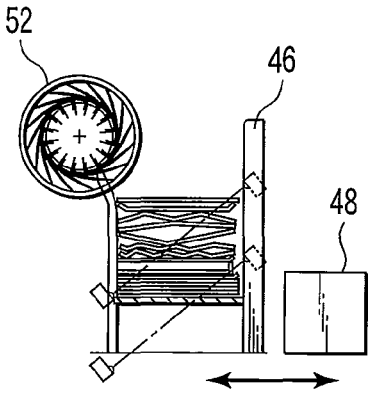
FIG. 17D is an illustration showing a state of stacking notes in the stacking box of FIG. 2, with the position of a width guide controlled variably according to the quality and condition of a note.
Figure 17E:
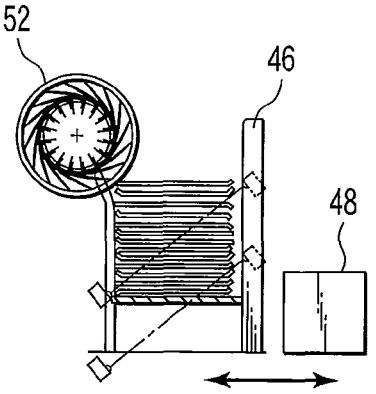
FIG. 17E is an illustration showing a state of stacking notes in the stacking box of FIG. 2, with the position of a width guide controlled variably according to the quality and condition of a note.

In this case, if the note is brand new or good in quality and condition, the note can be stacked neatly in a suitable state, by adjusting the width guide 46 of the stacking box to a reference position, as shown in FIG. 16A.

However, if the note is old and bad in quality, the note is caught by the width guide 46 and stood or inclined when stacking, causing a stack error as shown in FIGS. 16B-16E.

In the present invention, as shown in FIGS. 17A-17E, the width guide 46 of a stacking box is adjusted to a note size+3−5 mm, for example, to give allowance, based on the result of judgment by the judgment device 41.

In this case, a note can be stacked without being caught by the width guide 46 of the stacking box, as shown in FIGS. 17A-17E, and the stacking performance can be improved.

As described above, the stacking performance can be stabilized by controlling to adjust the width guide 46 of the stacking box 28 (28-33) to an optimum value, based on the result of judgment of each note by the judgment device 41.

Next, explanation will be give on the operation of the aligning mechanism 53 during stacking of notes.

When the quality and condition of a note are judged by the judgment device 41 as described above, the control device 42 controls the operation of the third driving motor 58 based on the result of judgment, and variably controls the operation of the aligning guides 54 and 55, that is, the speed, amplitude, times and timing of alignment.

FIG. 18 shows an example of a position aligning method according to conditions of a note.

A note with adhesion of tape is aligned at a standard speed and amplitude.

A note with broken corner is aligned at a low speed and standard amplitude in the air before stacking.

A note with a peeled-off edge is aligned at a low speed and standard amplitude in the air before stacking.

A note with a bent corner (raised) is aligned at a low speed and standard amplitude in the air before stacking.

A wrinkled note is softly aligned at a low speed and small amplitude immediately before stacking.

A tired note is softly aligned at a low speed and small amplitude immediately before stacking.

A note with a V-shaped bent is aligned at a low speed and standard amplitude.

A note with a cross-shaped bent is aligned at a low speed and standard amplitude.

A note with a bent into eight portions is aligned at a low speed and standard amplitude.

A note bent at both corners is aligned in the air after feeding out from the impeller and before stacking.

A normal note is aligned at a standard speed and amplitude, if the quality and condition are good.

A brand new note is aligned at a low speed and standard amplitude (the note pops out if tapped strongly).

The aligning operation of the aligning guides 54 and 55 are controlled optimally based on the result of judgment of each note by the judgment device 41 as described above, and the stacking performance can be stabilized.

Next, explanation will be given on the position control of the impeller during stacking of notes.

When the judgment device 41 judges the condition of a note and the position of a note in the sliding direction as described above, the control device 42 controls the driving of the fourth and fifth driving motors 74 and 75 based on the judgment result, and variably controls the positions of the first and second impellers 52*a* and 52*b*.

Figure 19A:
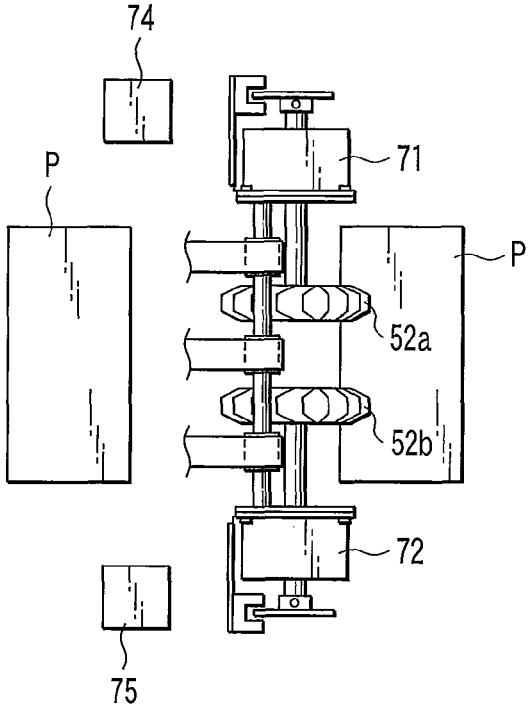
FIG. 19A is an illustration showing a position control of the impeller of FIG. 7.

Namely, when a standard size note is fed without displacing from the center of feeding as shown in FIG. 19A, the first and second impellers 52*a* and 52*b* are set to a standard position.

Figure 19B:
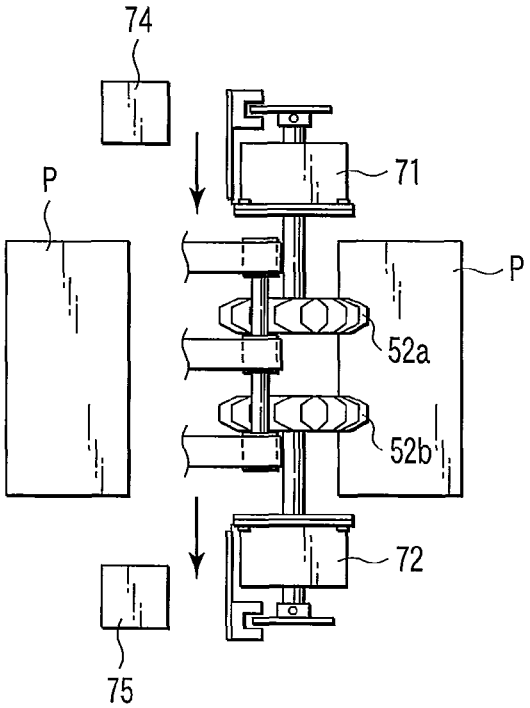
FIG. 19B is an illustration showing a position control of the impeller of FIG. 7.
Figure 19C:
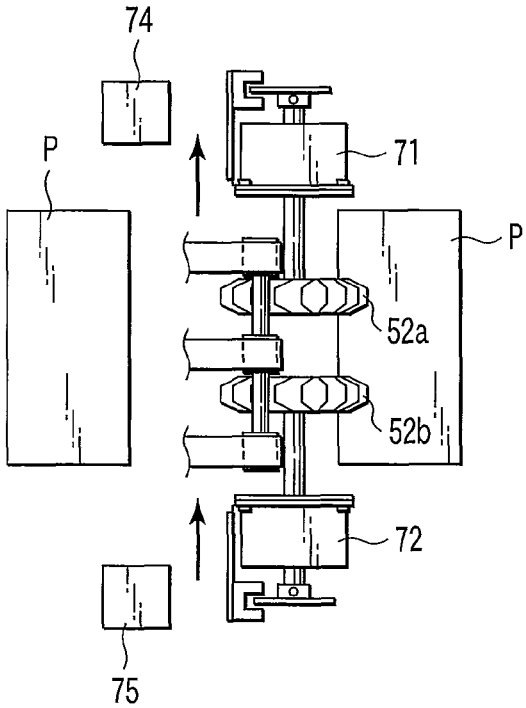
FIG. 19C is an illustration showing a position control of the impeller of FIG. 7.

When a note is fed displaced in the direction of crossing the center of feeding as shown in FIG. 19B or 19C, the first and second impellers 52*a* and 52*b* are moved in the direction crossing the center of feeding with respect to the shifted note, and adjusted to the position of the note.

Figure 20A:
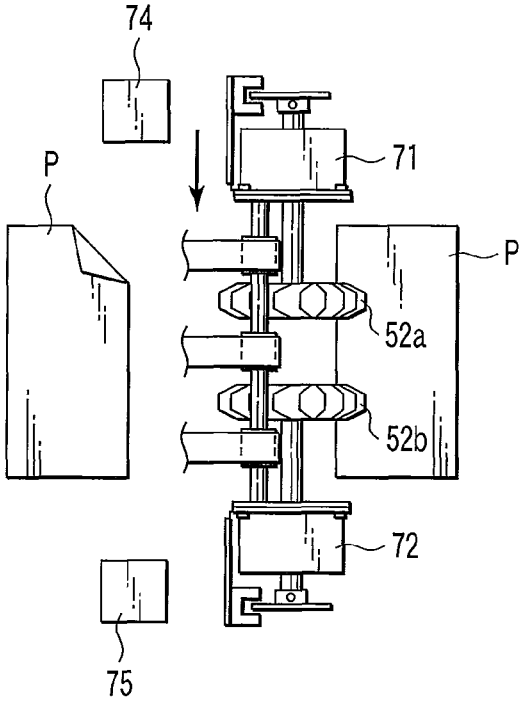
FIG. 20A is an illustration showing a position control of the impeller of FIG. 7.

If a note is fed asymmetrically due to a peeled off edge or a largely bent or broken corner as shown in FIG. 20A, the first impeller 52*a* is moved in the sliding direction as indicated by an arrow by driving only the fourth driving motor 74, and optimized to meet the position and the center of gravity of the note.

Figure 20B:
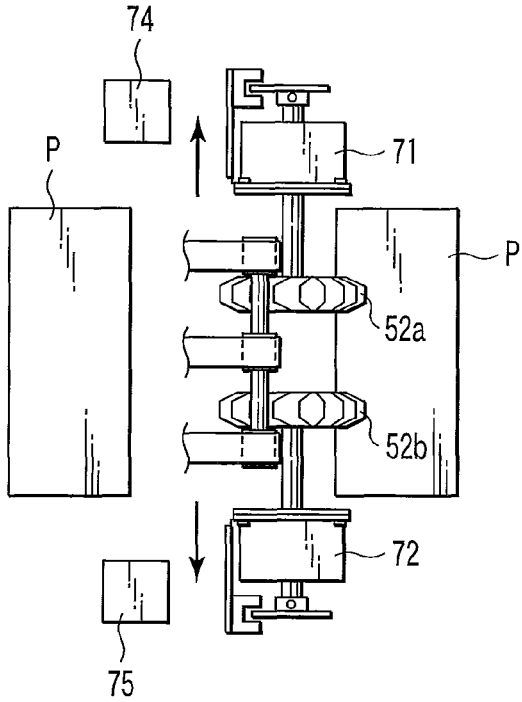
FIG. 20B is an illustration showing a position control of the impeller of FIG. 7.

When a note larger than the standard size is fed as shown in FIG. 20B, the first and second impellers 52*a* and 52*b* are moved in the direction of separating away from each other as indicated by an arrow.

Figure 20C:
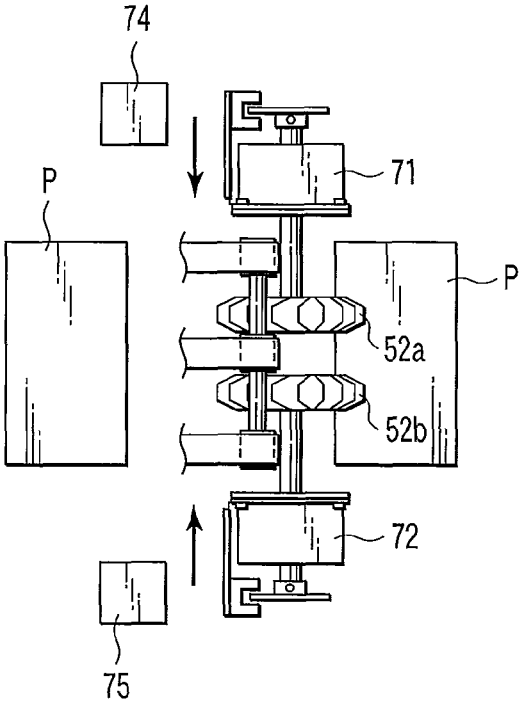
FIG. 20C is an illustration showing a position control of the impeller of FIG. 7.

When a note smaller than a standard size is fed as shown in FIG. 20C, the first and second impellers 52*a* and 52*b* are moved in the direction of closing to each other as indicated by an arrow.

As described above, by moving the positions of the impellers 52*a* and 52*b* according to the position and the center of gravity of a note, a note stacking performance can be largely improved without dropping or popping out a note from the impellers 52*a* and 52*b*, irrespective of whether a note is displaced to the sliding direction from the center of feeding, asymmetrical due to peeling-off or bent or broke corner, or larger or smaller than a standard size.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet processing apparatus comprising:

a setting unit which sets paper sheets of a rectangular shape;

a take-in device which takes in the paper sheets set in the setting unit;

a judgment device which judges the quality and condition of a paper sheet taken in by the take-in device;

a stacking device which loads the paper sheets judged with regard to the quality and condition by the judgment device therein and stacks the paper sheets by dropping the sheets one on another;

a position adjusting mechanism which adjusts a paper sheet stacked in the stacking device by reciprocating a pair of position adjusting guides to attach to and detach from both longitudinal ends of the paper sheet; and a control device which variably controls the position adjusting operation of the pair of position adjusting guides of the position adjusting mechanism based on the quality and condition of the paper sheet judged by the judgment device.

2. The paper sheet processing apparatus according to claim 1, wherein the control device controls the position adjusting speed, position adjusting amplitude, position adjusting times, and position adjusting timing of the pair of position adjusting guides.

3. The paper sheet processing apparatus according to claim 2, wherein the quality of the paper sheet includes wrinkled and tired.

4. The paper sheet processing apparatus according to claim 2, wherein the conditions of the paper sheet include adhesion of tape, broken corner, peeled-off edge, V-shaped bent, cross-shaped bent into four portions, and bent into eight portions.

5. The paper sheet processing apparatus according to claim 4, wherein the control device controls the pair of position adjusting guides to reciprocate at a low speed and a normal amplitude so as to adjust the position of the paper sheet at a timing in the middle of dropping the paper sheet in the stacking device after being loaded thereinto, based on the judgment that the paper sheet is in the condition of adhesion of tape, broken corner or peeled-off edge.

6. The paper sheet processing apparatus according to claim 3, wherein the control device controls the pair of position adjusting guides to reciprocate at a low speed and at an amplitude smaller than a normal amplitude so as to adjust the position of the paper sheet at a timing immediately before the paper sheet being placed on an inner bottom surface of the stacking device, based on the judgment that the quality of the paper sheet is wrinkled or tired.

7. The paper sheet processing apparatus according to claim 4, wherein the control device controls the pair of position adjusting guides to reciprocate at a low speed and a normal amplitude so as to adjust the position of the paper sheet, based on the judgment that the paper sheet is in the condition of V-shaped bent, cross-shaped bent into four portions, or bent into eight portions.

* * * * *